US008864331B2

(12) United States Patent
Kalb et al.

(10) Patent No.: US 8,864,331 B2
(45) Date of Patent: Oct. 21, 2014

(54) COMBINATION PLANTER BOX AND SAUCER WITH INTERNAL LIGHTING

(71) Applicants: David Kalb, Brisbane, CA (US); Todd Lyon, San Jose, CA (US)

(72) Inventors: David Kalb, Brisbane, CA (US); Todd Lyon, San Jose, CA (US)

( * ) Notice: Subject to any disclaimer, the term of this patent is extended or adjusted under 35 U.S.C. 154(b) by 77 days.

(21) Appl. No.: 13/694,980

(22) Filed: Jan. 23, 2013

(65) Prior Publication Data

US 2014/0036484 A1 Feb. 6, 2014

(51) Int. Cl.
*F21V 33/00* (2006.01)

(52) U.S. Cl.
USPC ..... 362/154

(58) Field of Classification Search
None
See application file for complete search history.

(56) References Cited

U.S. PATENT DOCUMENTS

| | | | | |
|---|---|---|---|---|
| 5,741,061 | A * | 4/1998 | Lehmann et al. | 362/154 |
| 5,879,071 | A * | 3/1999 | Sanford, Jr. | 362/154 |
| 6,076,940 | A * | 6/2000 | Sanford, Jr. | 362/253 |
| 2010/0141156 | A1 * | 6/2010 | Canino et al. | 315/154 |
| 2012/0057332 | A1 * | 3/2012 | Cohen | 362/183 |

* cited by examiner

*Primary Examiner* — Donald Raleigh
(74) *Attorney, Agent, or Firm* — Bruce H Johnsonbaugh

(57) ABSTRACT

An illumination system is provided for illuminating a planter box used to provide lighting for walkways, stairs, decks and the like. Indirect lighting is provided for illuminating the planter box with up-lighting and the supporting surface for the planter box with down-lighting. In a preferred embodiment, each LED is solar powered and provides both indirect up-lighting and indirect down-lighting simultaneously.

8 Claims, 11 Drawing Sheets

COMBINATION PLANTER BOX AND SAUCER WITH INTERNAL LIGHTING

CROSS-REFERENCE TO RELATED APPLICATION

This application claims the benefit of and priority from U.S. provisional application Ser. No. 61/632,656 filed Jan. 27, 2012.

BACKGROUND

The present invention pertains generally to illuminated items, such as (in one embodiment) potted plants mounted in saucers, which are utilized to illuminate walkways, decks, docks, stairs and the like. The illumination provides a visual guide along with a pleasant, novel ambiance.

BRIEF SUMMARY OF THE INVENTION

The present invention provides an illumination system, which in its preferred embodiment, provides solar powered indirect "up-lighting" of a planter box, and simultaneously, indirect "down-lighting" of the supporting surface for the planter box from each of a plurality of LED light sources. The device uses a recessed saucer which houses the illumination system, together with a planter box carried in the recess of the saucer.

Less preferred embodiments include only "up-lighting," or only "down-lighting," or utilize line voltage rather than solar power.

A primary object of the invention is to provide a solar powered illumination system which provides efficient, indirect up-lighting and indirect down-lighting simultaneously from individual light sources for planter boxes used on walkways, decks, docks, outside stairwells and the like.

A further object is to provide an illumination system for outdoor planter boxes which is both solar powered and rugged, wherein the fragile components are protected from impact damage and weather damage.

A further object is to provide an outdoor illumination system for planter boxes that utilizes a saucer which houses the illumination system, and wherein the saucer may be utilized with a variety of different planter boxes.

Other advantages will become apparent from the following description and drawings.

DETAILED DESCRIPTION OF THE DRAWINGS

Figure 1:
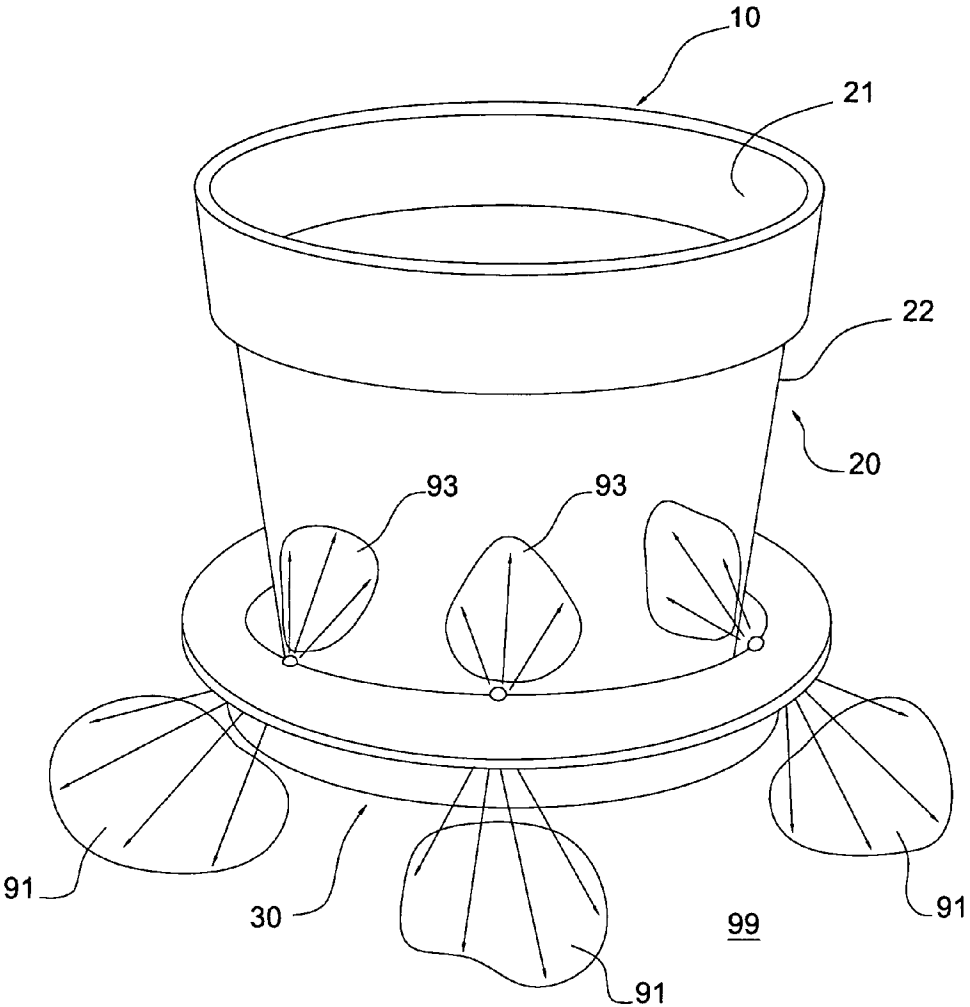
FIG. 1 is a perspective view of the invention, showing the simultaneous up-lighting and down-lighting from each light source.

FIG. 1 is a perspective view of the combination 10 of a planter box 20 carried by a saucer 30. The "down" lighting produces illuminated areas 91 of the supporting surface 99 below the saucer 30. Planter box 20 has an open top 21, side walls 22 and a bottom (not visible) as is known in the art. The "up" lighting produces illuminated areas 93 on the outer surface of planter box 20. The result is a pleasant, decorative visual guide as noted above, and also provides an ambiance that is novel.

Figure 2:
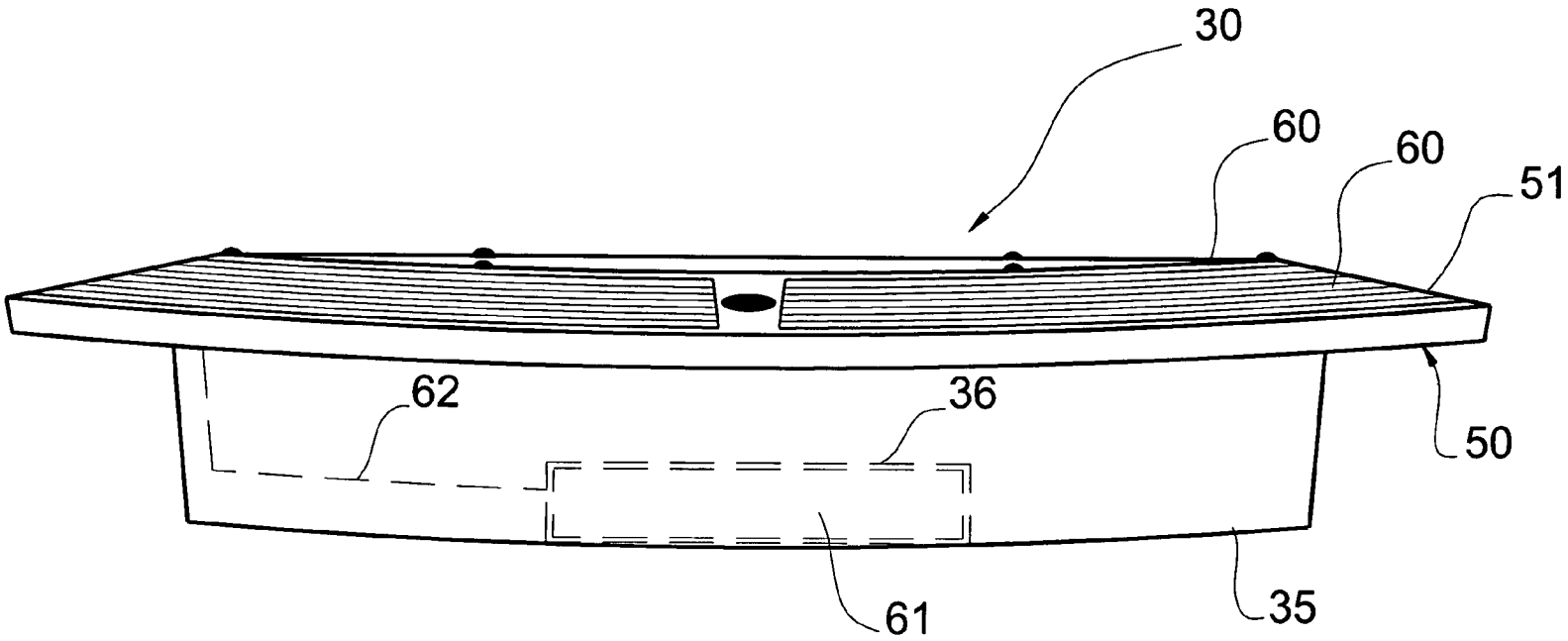
FIG. 2 is an elevational view of a saucer used in a less preferred embodiment of the invention.

FIG. 2 is an elevational view of one embodiment of saucer 30. Saucer 30 has a base 35 which carries a wing 50. Wing 50 extends radially outwardly, is inclined downwardly, and has a generally flat, disc shaped top surface 51 which carries a photovoltaic plastic power strip 60, or other solar collector. Base 35 includes a cavity 36 which is waterproof and which houses a rechargeable battery 61. Battery 61 is electrically connected to power strip 60 by conductor 62 and is charged by power strip 60.

Figure 3:
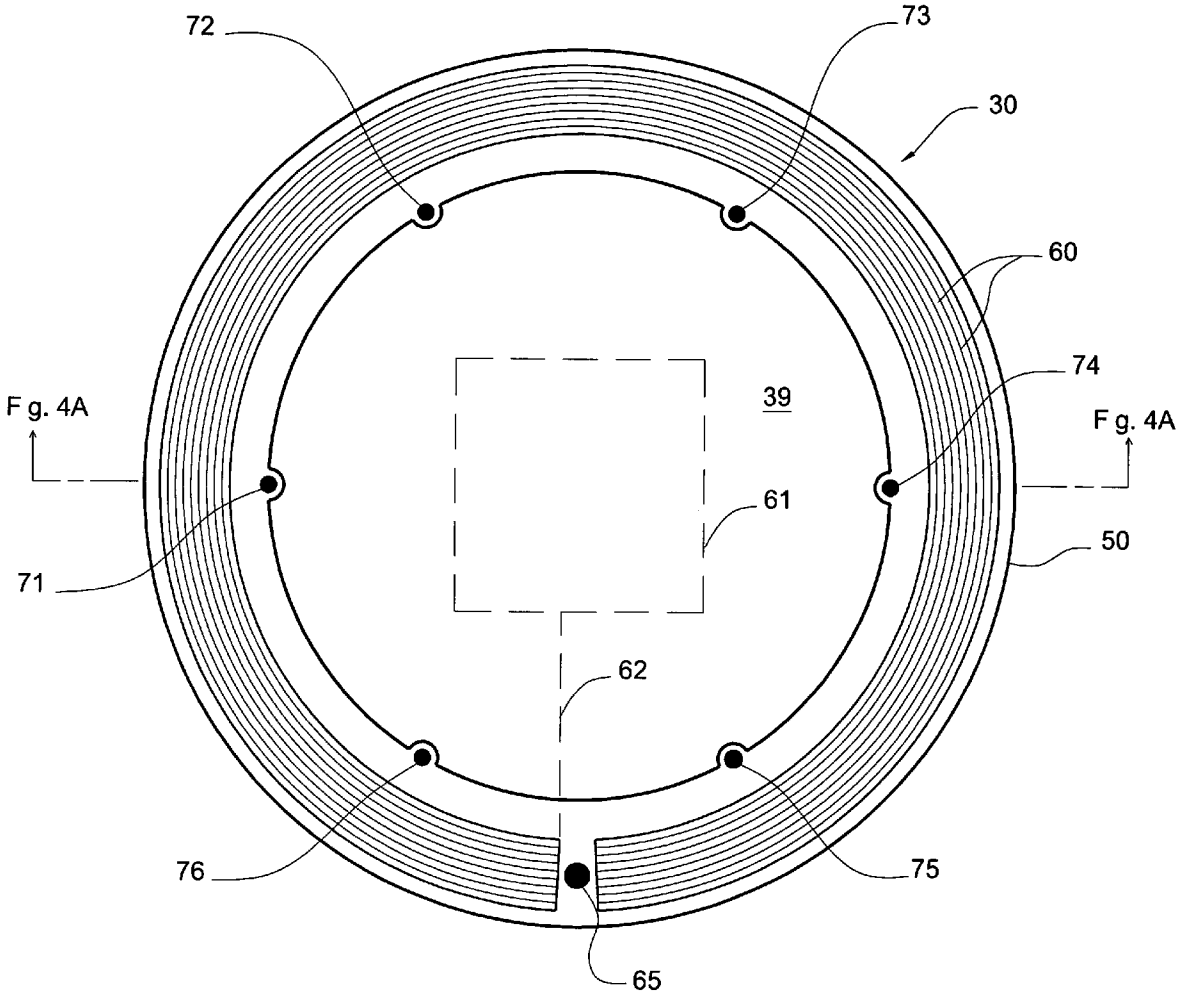
FIG. 3 is a plan view of the saucer of FIG. 2.

FIG. 3 is a plan view of saucer 30, showing power strip 60 carried by wing 50. Power strip 60 is circular and disc shaped in the embodiment shown. A plurality of up lights 71-76 is provided, mounted on the upper surface of wing 50 of saucer 30. The up lights are preferably LED's, which tend not to attract insects. Battery 61 and electrical conductor 62 are shown in phantom in FIG. 3. A light sensor 65 is carried by wing 50 and is electrically connected to conductor 62 and battery 61. Light sensor 65 activates the lights at a predetermined level of darkness, and turns off the lights at a predetermined level of light.

Figure 4A:
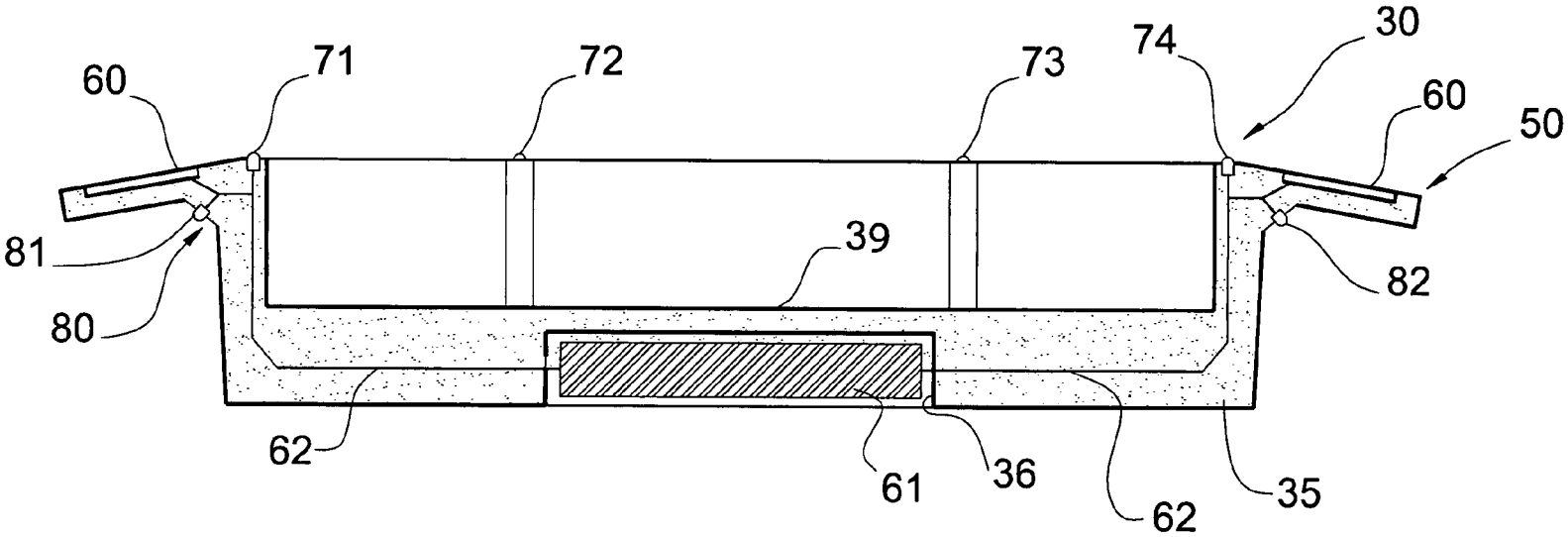
FIG. 4A is a section on the line FIG. 4A-FIG. 4A shown in FIG. 3.

FIG. 4A is a sectional view on the line FIG. 4A-FIG. 4A shown in FIG. 3. The base 35 of saucer 30 is integrally formed with wing 50. Solar collector 60 is carried by the wing 50. The upper surface 39 of base 35 is recessed below wing 50 and carries planter box 20 (not shown in FIGS. 2-4B). Up-lights 71-74 (visible in FIG. 4A) extend above the top surface of wing 50.

A plurality of down lights 80 includes two down lights 81 and 82 visible in FIG. 4A. Down lights 81 and 82 are carried by base 35 below wing 50. Down lights are preferably LED's. Battery 61 is electrically connected to up lights 71-74 and down lights 81, 82 by conductors 62. Cavity 36 formed in base 35 is a waterproof cavity.

As shown in FIG. 4A, the up-light 71 is aligned vertically with down-light 81. It is to be understood that the up and down-lights need not be aligned vertically. A different number of down-lights may be used compared to the number of up-lights. Furthermore, spacing of the lights circumferentially need not be uniform.

Saucer 30 as shown in FIGS. 2-4B may be utilized with a number of interchangeable planter boxes. Saucer 30 as shown in FIGS. 2-4B may have the lights powered by conventional 110 volt electricity transformed to a low voltage, as opposed to being battery powered.

The embodiment shown in FIGS. 2-4B has the advantage that the wing 50 is integrally formed with the base 35 of saucer 30. However, the disadvantage of this embodiment is that each LED light source provides either up-lighting or down-lighting, not both.

Figure 4B:
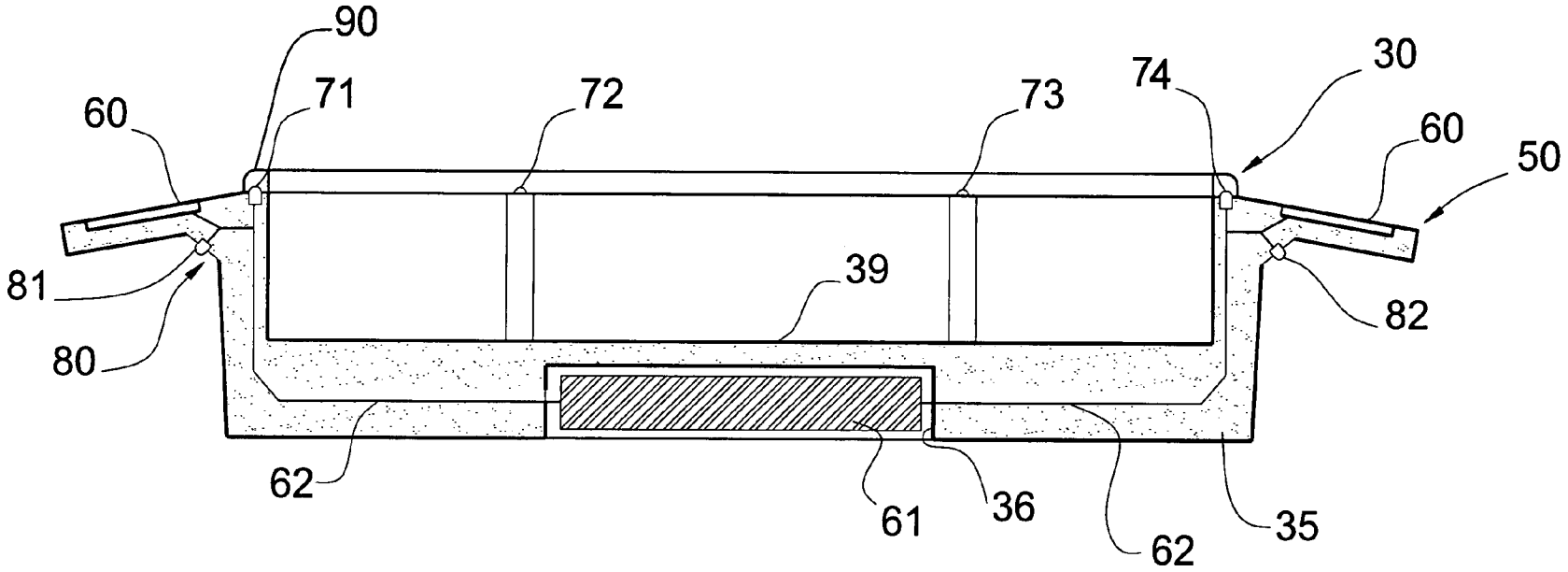
FIG. 4B is a schematic showing an optional diffuser.

As shown in FIG. 4B, embodiment of FIGS. 2-4A may include an optional diffuser ring 90 covering the up lights 71-76 to soften the up-lighting and provide protection for lights 71-76.

Figure 5:
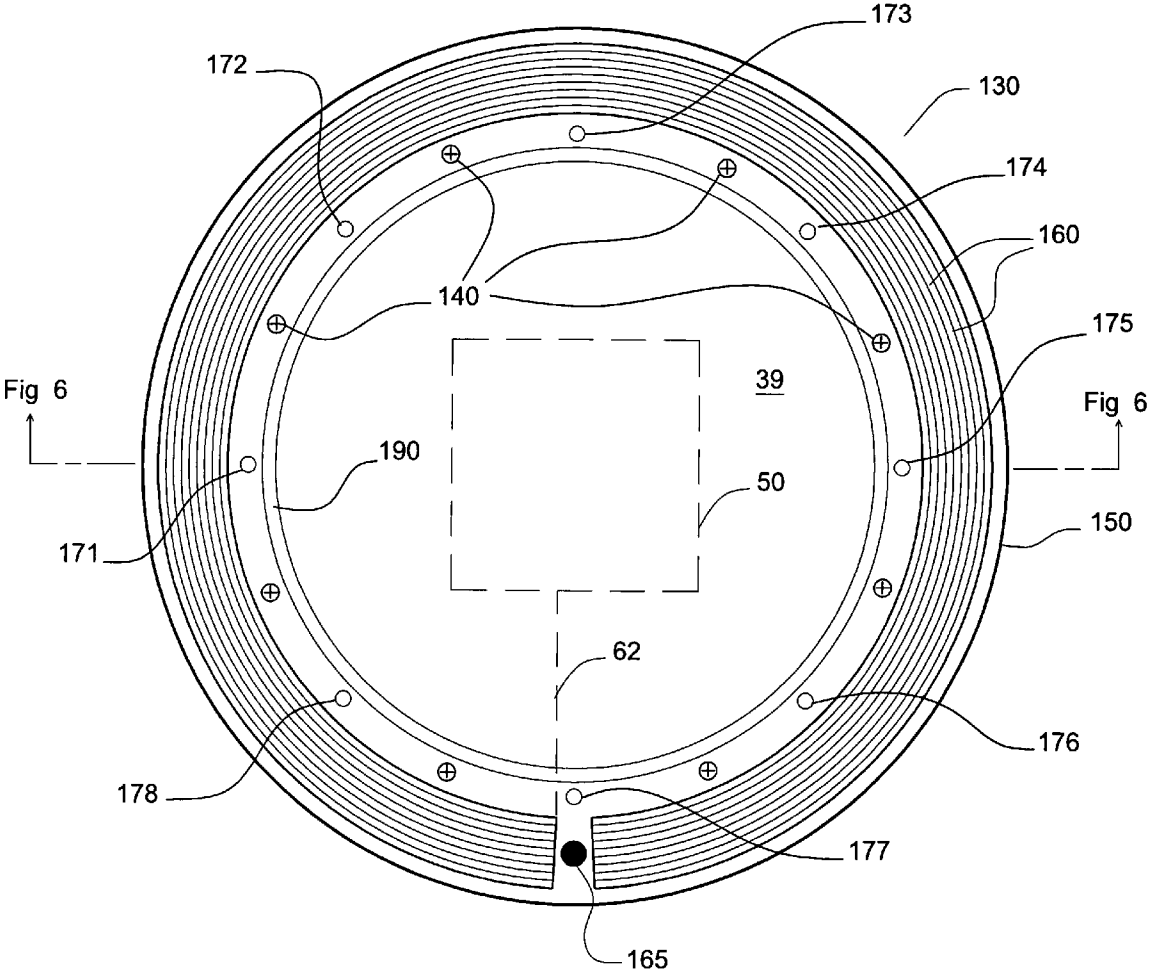
FIG. 5 is a plan view of the saucer used in the preferred form of the invention.
Figure 6:
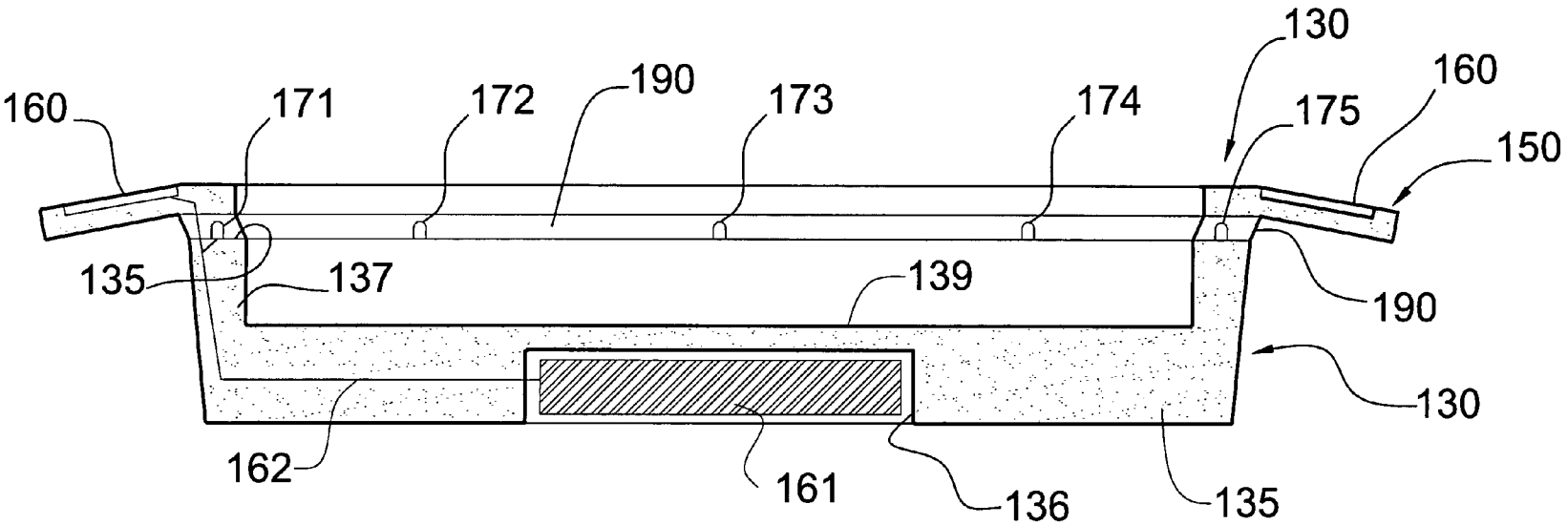
FIG. 6 is a section on the line FIG. 6-FIG. 6 of FIG. 5.
Figure 7:
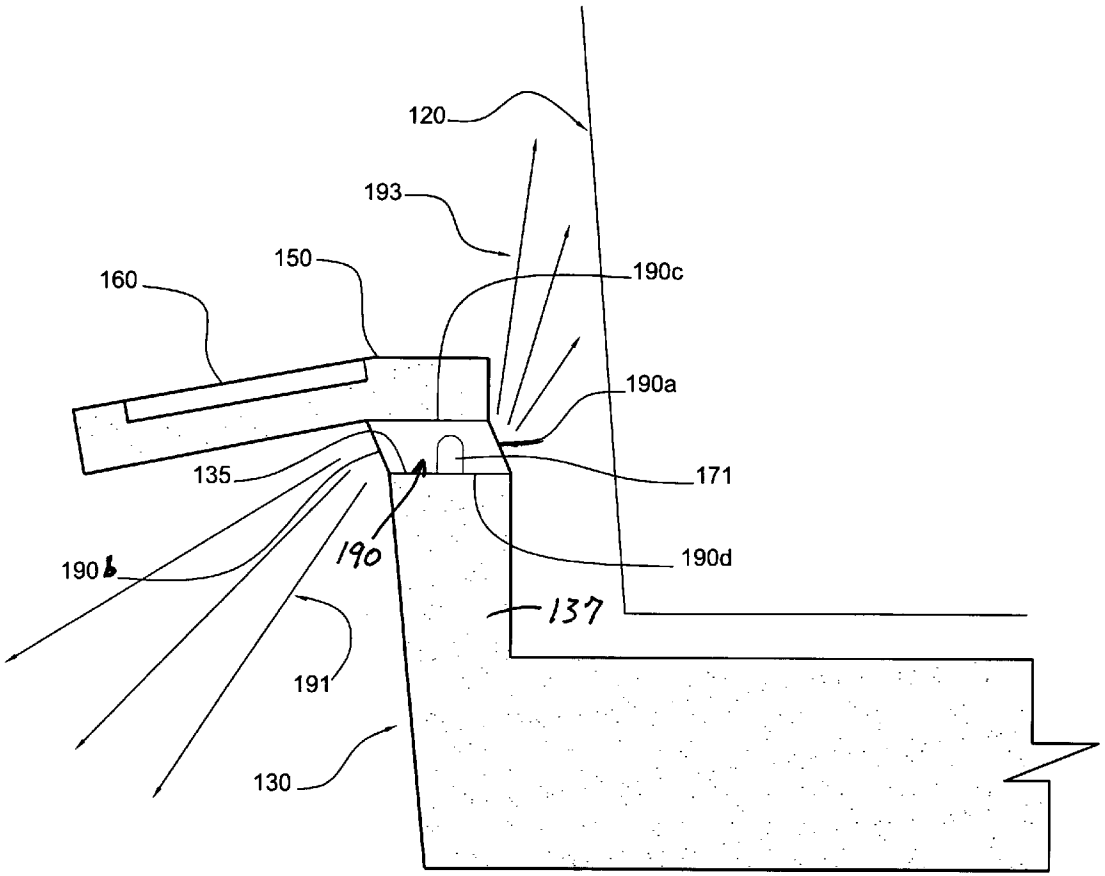
FIG. 7 is an enlargement of a portion of FIG. 6 showing the preferred diffuser design.

A preferred embodiment of the invention is shown in FIGS. 5-7. In this embodiment, the LED's 171-178 are either imbedded in or mounted below a single, monolithic acrylic light diffuser ring 190, partially visible in FIG. 5. The LED's 171-178 are carried by shoulder 135 of side wall 137 (see FIG. 6) of saucer 130. The wing 150 in this embodiment is a separate piece, attached to saucer 130 by a plurality of screws 140 extending through wing 150, diffuser 190 and into shoulder 135 of saucer 130. By covering all the LED's with diffuser 190, the "down-lighting" and "up-lighting" are both diffused (and indirect) and the LED's are protected from impact damage and from the weather. Indirect up-lighting and indirect down-lighting are produced by each LED, a significant aspect of the invention, reducing cost and providing a pleasant effect. The acrylic ring 190 acts as a light diffuser to produce a more diffuse, and softer, light for the "up-lighting" and/or "down-lighting." The diffuser 190 may be utilized to diffuse light from all the LED's 171-178 or only some of the LED's. If the diffuser 190 is used with some of the LED's 171-178, the remainder of the LED's may be positioned to provide light directly for "up-lighting" and/or "down-lighting" and without diffusion as shown in FIGS. 1-4. The other aspects of the embodiment shown in FIGS. 5 and 6 are the same as those shown in FIGS. 2-4B.

FIG. 6 is a section on the line FIG. 6-FIG. 6 of FIG. 5.

FIG. 7 is a section of a portion of FIG. 6. Light 171 (preferably an LED) is shown carried on shoulder 135 of side wall 137 of saucer 130. Diffuser ring 190 covers all lights 171-178 and is carried by shoulder 135. Shoulder 135 is below wing 150, and diffuser 190 also is below wing 150. Indirect down-lighting 191 is shown exiting diffuser 190 below wing 150. Light emitted from LED 171 simultaneously emits indirect up-lighting 193 to illuminate the side of planter box 120. Wing 150 is attached to saucer 130 by screws 140 (not shown in FIG. 7, but shown in FIG. 6).

As shown in FIG. 7, the inside surface 190*a* and outside surface 190*b* of the diffuser 190 each form an inverted, truncated cone wherein the top of the diffuser 190*c* forms the base of the cone, and the bottom of the diffuser 190*d* forms the apex of the truncated cone.

The shape of the diffuser 190 and wing 150 interacting with the LED's, constitutes the means for directing light upwardly or downwardly. Those shapes can be modified to accomplish the desired indirect up-lighting and down-lighting. The phrase "indirect lighting" means that the light source is not directly viewable by an observer.

Figure 8:
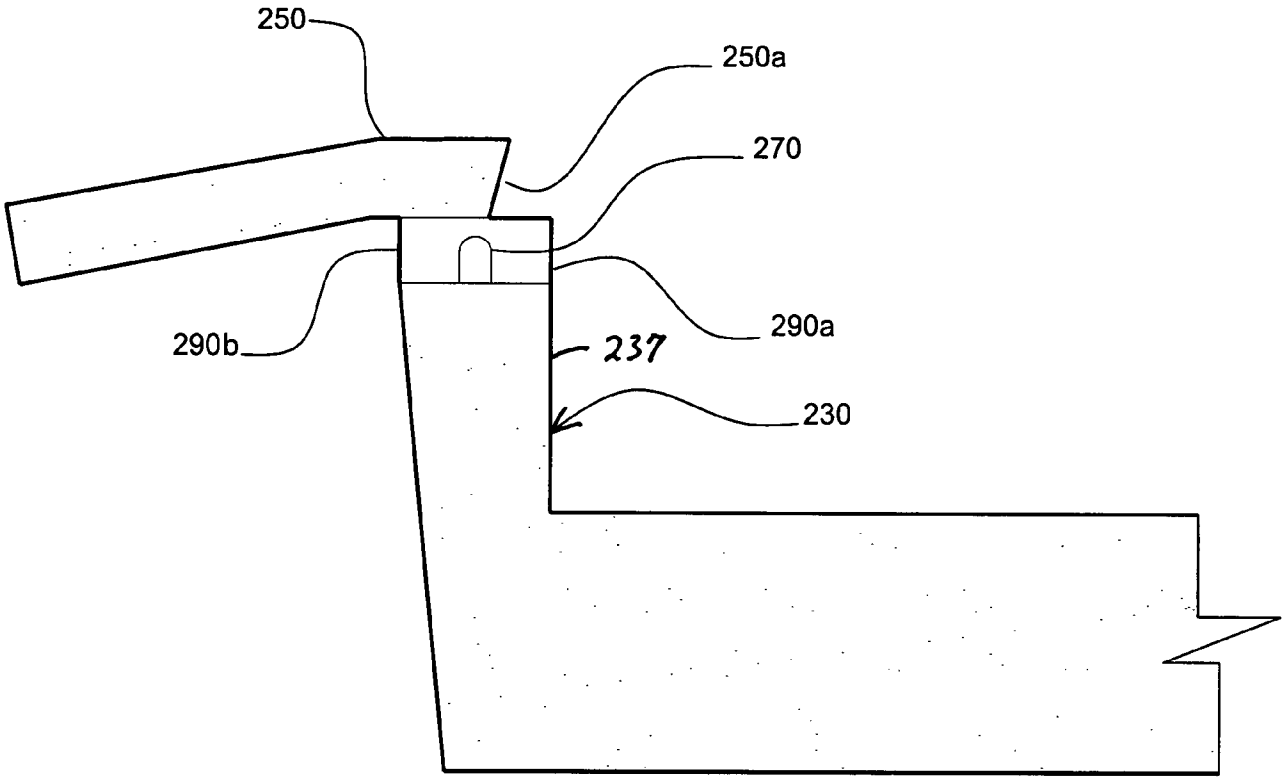
FIG. 8 is a schematic showing an alternate diffuser and wing design.

For example, as shown in FIG. 8, diffuser 290, has a vertical inside wall 290*a* and a vertical outside wall 290*b*. The inside wall 250*a* of wing 250 is inclined upwardly toward the center of saucer 230 to cause all the upward output of LED to impact the wall of a planter box (not shown in FIG. 8) to provide the desired indirect up-lighting.

Figure 9A:
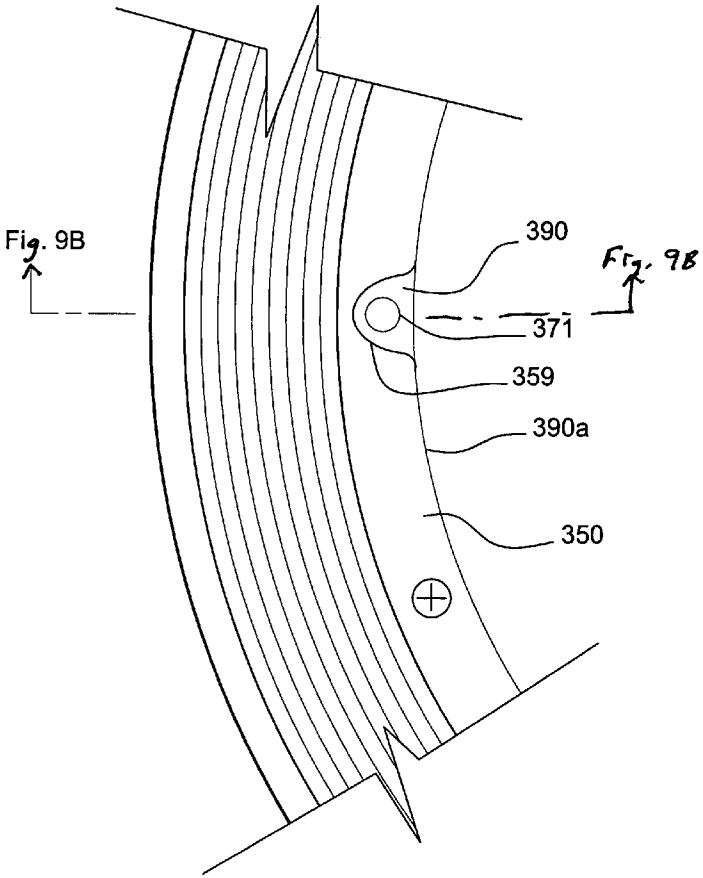
FIGS. 9A and 9B are schematics showing another diffuser and wing design.
Figure 9B:
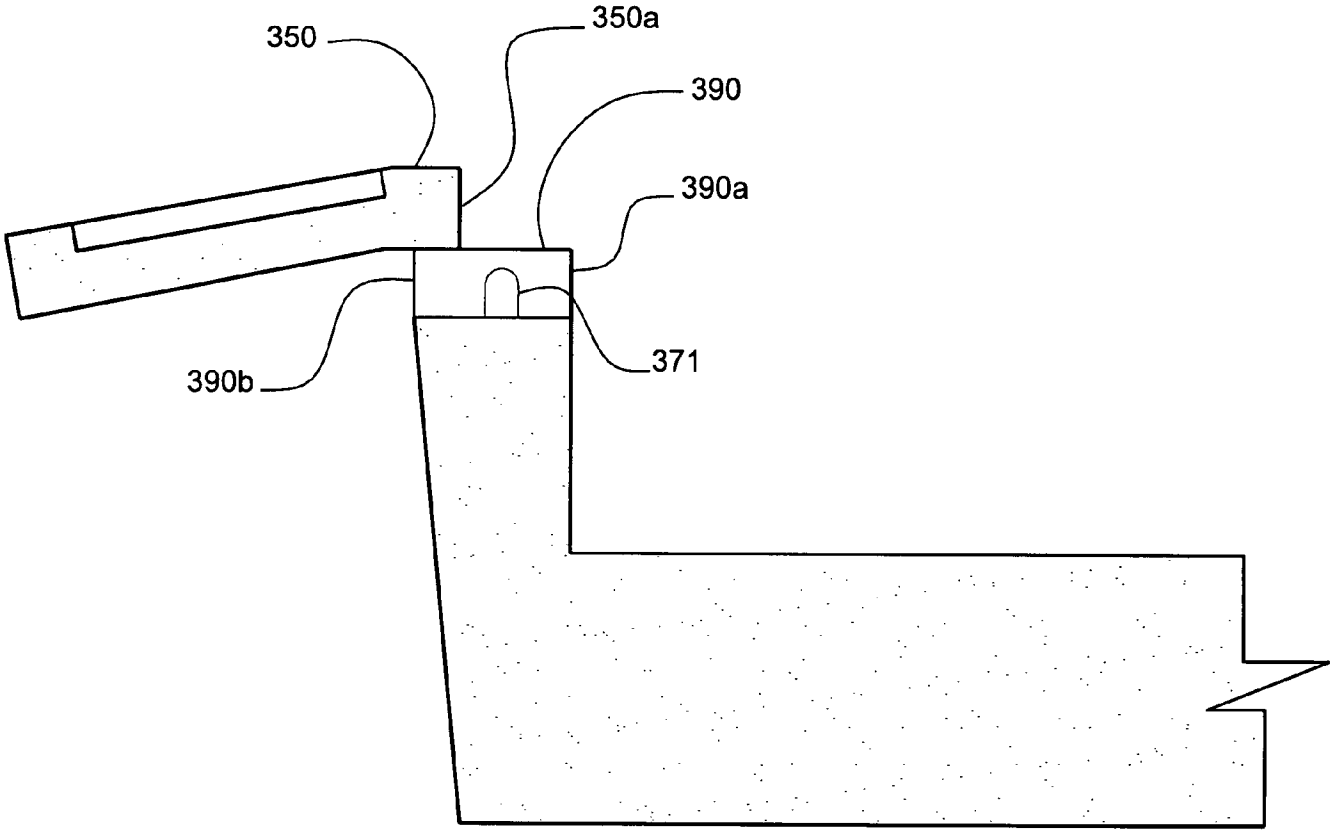

As another example, as shown in FIGS. 9A and 9B, diffuser 390 may have a vertical inside wall 390*a* and a vertical outside wall 390*b*. Wing 350 has a vertical inside wall 350*a*, except that wing 350 has recesses 359 formed for each of the light sources such as 371 shows.

The wing 50, 150, 250 and 350 in each embodiment is inclined downwardly from the horizontal between 5° and 30°.

A less preferred, alternative form of the invention could have the planter box integrally formed with the saucer.

It is to be understood the invention may be used indoors or outdoors, and may be used on walkways, decks, balconies, porches, patios, entryways, stairs, hard and soft landscape areas, promenades, boat docks and other outdoor areas.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments suited to the particular use contemplated.

What is claimed is:

1. A solar powered, illuminated planter box and saucer to be placed on a supporting surface comprising, in combination:

a planter box having a bottom, side walls and an open top, a saucer having a top, said top having a recess adapted to carry said planter box, said recess having a side wall and a shoulder formed by the top of said side wall, a plurality of lights carried by said shoulder of said recess side wall, a diffuser carried on top of said shoulder of said recess side wall, said diffuser extending over said plurality of lights, said diffuser comprising a single, monolithic member to diffuse light and protect said plurality of lights, a wing mounted above said diffuser and having a generally flat surface forming a wing extending radially outwardly from said recess, solar collector means carried by said flat surface of said wing, means for directing output from each of said lights upwardly through said diffuser and onto said side wall of said planter box, and means for directing output from each of said lights downwardly, below said wing and onto said supporting surface whereby the output of each light is simultaneously directed upwardly toward said side wall of said planter box and downwardly toward said supporting surface of said saucer, creating indirect up lighting and indirect down lighting from each of said plurality of lights.

2. The apparatus of claim 1 wherein said wing is inclined downwardly between 5° and 30°.

3. The apparatus of claim 1 wherein said diffuser has an inner surface and an outer surface each forming an inverted, truncated cone.

4. The apparatus of claim 1 wherein said means for directing light upwardly is the inner surface of said diffuser forming an inverted, truncated cone.

5. The apparatus of claim 1 wherein said means for directing light downwardly is the outer surface of said diffuser forming an inverted, truncated cone.

6. An illuminated planter box and saucer to be placed on a supporting surface comprising, in combination:

a planter box having a bottom, side walls and an open top, a saucer having a top, said top having a recess adapted to carry said planter box, said recess having a side wall and a shoulder formed by the top of said side wall, a plurality of lights carried by said shoulder of said recess side wall, a diffuser carried on top of said shoulder of said recess side wall, said diffuser extending over said plurality of lights, said diffuser comprising a single, monolithic member to diffuse light and protect said plurality of lights, a wing mounted above said diffuser and having a generally flat surface forming a wing extending radially outwardly from said recess, means for directing output from each of said lights upwardly through said diffuser and onto said side wall of said planter box, and means for directing output from each of said lights downwardly, below said wing and onto said supporting surface whereby the output of each light is simultaneously directed upwardly toward said side wall of said planter box and downwardly toward said supporting surface of said saucer, creating indirect up-lighting and indirect down-lighting from each of said plurality of lights.

7. The apparatus of claim 6 wherein said wing extends downwardly in a direction running outwardly from said recess of said saucer.

8. A solar powered, illuminated planter box and saucer to be placed on a supporting surface comprising, in combination:

a planter box having a bottom, side walls and an open top, a saucer having a top, said top having a recess adapted to carry said planter box, a diffuser carried on top of said shoulder of said recess side wall, said diffuser extending over said first plurality of lights, said diffuser comprising a single, monolithic member to diffuse light upwardly and protect said plurality of lights from impact damage and weather, a wing forming the top of said saucer and having a generally flat surface extending radially outwardly from said recess, a first plurality of lights carried by said top of said wing, solar collector means carried by said flat surface of said wing, a second plurality of lights mounted below said wing, means for directing output from each of said second plurality of lights downwardly, below said wing and onto said supporting surface means for directing light upwardly toward said side wall of said planter box from said first plurality of lights.

* * * * *